US009024222B2

(12) United States Patent
Ishikawa et al.

(10) Patent No.: US 9,024,222 B2
(45) Date of Patent: May 5, 2015

(54) PUSH SWITCH

(71) Applicant: Panasonic Corporation, Osaka (JP)

(72) Inventors: Takayuki Ishikawa, Fukui (JP); Yasuchika Kudo, Fukui (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 204 days.

(21) Appl. No.: 13/757,365

(22) Filed: Feb. 1, 2013

(65) Prior Publication Data

US 2013/0199914 A1 Aug. 8, 2013

(30) Foreign Application Priority Data

Feb. 3, 2012 (JP) ..... 2012-021918

(51) Int. Cl.

| | |
|---|---|
| ***H01H 3/42*** | (2006.01) |
| ***H01H 13/14*** | (2006.01) |
| ***H01H 13/36*** | (2006.01) |
| *H01H 1/20* | (2006.01) |

(52) U.S. Cl.

CPC ..... *H01H 13/14* (2013.01); *H01H 1/20* (2013.01); *H01H 13/36* (2013.01)

(58) Field of Classification Search

CPC ..... H01H 3/42; H01H 15/00; H01H 15/10; H01H 19/635; H01H 21/00; H01H 3/02; H01H 13/14; H01H 3/04; H01H 3/20; H01H 3/48

USPC ..... 200/16 R, 553, 537, 529, 520, 335, 341

See application file for complete search history.

(56) References Cited

U.S. PATENT DOCUMENTS

| | | | | |
|---|---|---|---|---|
| 5,841,085 | A * | 11/1998 | Rittinghaus et al. | 200/16 R |
| 6,384,358 | B1 * | 5/2002 | Hirose | 200/533 |
| 2007/0007117 | A1 | 1/2007 | Kodoh | |

FOREIGN PATENT DOCUMENTS

JP 2007-018790 A 1/2007

* cited by examiner

*Primary Examiner* — Edwin A. Leon
*Assistant Examiner* — Anthony R. Jimenez
(74) *Attorney, Agent, or Firm* — McDermott Will & Emery LLP

(57) ABSTRACT

A push switch according to the present invention includes a case with a substantially-box shape, a cover, a manipulation member, a movable contact point, and a spring with a substantially-U-shape. The case with the substantially-box shape is provided with a common contact point and a fixed contact point in its inner bottom surface. The movable contact point is swayably placed on the common contact point and is extended in a leftward and rightward direction. The spring with the substantially-U-shape has one end hitched on a lower surface of the cover, the other end slidably placed on an upper surface of the movable contact point, and a center portion being in elastic contact with a lower surface of the manipulation member. This enables to make the entire push switch have a reduced height and to certainly connect and separate relatively-larger electric currents of about several amperes therethrough.

11 Claims, 6 Drawing Sheets

PUSH SWITCH

BACKGROUND

1. Technical Field

The present invention relates to push switches which are to be mounted mainly in automobiles and are utilized for manipulating various types of electronic devices.

2. Description of the Related Art

In recent years, generally, various switches have been mounted in interiors of automobiles, in order to enable to manipulate various types of electronic devices, such as room lamps and car audio apparatuses. As push switches for use thereas, there has been a need for push switches having smaller sizes and smaller thicknesses while being able to be certainly manipulated.

Such a conventional push switch will be described, with reference to FIGS. 4 to 6.

FIG. 4 is a cross-sectional view of the conventional push switch, and FIG. 5 is an exploded perspective view of the conventional push switch. Referring to FIG. 4 and FIG. 5, "1" designates a case having an opened upper surface and having a substantially-box shape, wherein the case is made of an insulating resin. "2" designates a common contact point made of a conductive metal, and "3" and "4" designate fixed contact points made of conductive metals. Common contact point 2 is secured to the left inner side wall of case 1 at its center portion, and fixed contact points 3 and 4 are secured thereto above and below common contact point 2, through insert molding and the like.

Further, "5" designates a manipulation member made of an insulating resin. "6" designates a cover made of an insulating resin. Cover 6 is adapted to cover the opening portion in the upper surface of case 1, and manipulation member 5 is housed within case 1 such that manipulation member 5 is movable upwardly and downwardly. Manipulation portion 5A at the upper end of manipulation member 5 is upwardly protruded, through an opening in the upper surface of cover 6.

Further, "7" designates a movable contact point formed from a conductive metal thin plate, wherein its center portion, its upper end and its lower end are in elastic contact with common contact point 2, pushing portion 5B in the left side surface of manipulation member 5 and fixed contact point 4, respectively, in a state where the movable contact point is slightly bent. This realizes a state where common contact point 2 and fixed contact point 4 are electrically connected to each other, through movable contact point 7.

Further, "8" designates a stopper with a substantially angular-U shape which is formed from a metal wire. Stopper 8 is engaged, at its upper end, in cam slot 5C with a substantially-heart shape which is formed in the right side surface of manipulation member 5, while the lower end of stopper 8 is hitched on the inner bottom surface of case 1.

Further, "9" designates a spring formed from a metal wire wound in a coil shape. Spring 9 is mounted between the lower end of manipulation member 5 and the inner bottom surface of case 1 or the lower end of stopper 8, in a state where spring 9 is slightly bent. This spring 9 biases manipulation member 5 upwardly, thereby forming the push switch.

Further, the push switch having the aforementioned structure is mounted in an automobile interior, in a state where a push button and the like are mounted on manipulation portion 5A. Further, the push switch is placed on a printed wiring board (not illustrated) having a plurality of wiring patterns formed on its upper and lower surfaces. Common contact point 2 and fixed contact points 3 and 4, which are protruded through the bottom surface of case 1, are soldered to predetermined wiring patterns and, thus, are electrically connected to an electronic circuit (not illustrated) in a vehicle or a device.

In the aforementioned structure, if manipulation portion 5A is pushed, manipulation member 5 moves downwardly in case 1 while bending spring 9, as illustrated in the cross-sectional view in FIG. 6. Pushing portion 5B presses the upper end of movable contact 7 and, thus, movable contact point 7 sways in the leftward and rightward directions, with common contact point 2 served as a fulcrum point. The lower end of movable contact point 7 is separated from fixed contact point 4, while the upper end of movable contact point 7 is brought into elastic contact with fixed contact point 3. This realizes a state where common contact point 2 is electrically connected to fixed contact point 3 through movable contact point 7.

Further, at the same time, the upper end of stopper 8 slides in cam slot 5C having a substantially-heart shape, while being in elastic contact therewith. If manipulation member 5 is moved downwardly by a predetermined distance, the upper end of stopper 8 is hitched in cam slot 5C, thereby realizing a state where manipulation member 5 is locked. The electronic circuit detects that common contact point 2 is being electrically connected to or separated from fixed contact points 3 and 4, thereby turning on a room lamp, for example.

Further, if manipulation portion 5A is pushed, again, to move manipulation member 5 downwardly by a predetermined distance, the upper end of stopper 8 slides in cam slot 5C while being in elastic contact therewith, thereby releasing the lock. Manipulation member 5 is upwardly biased by spring 9, which separates the upper end of movable contact point 7 from fixed contact point 3, thereby returning to the original state where the lower end of movable contact point 7 is in elastic contact with fixed contact point 4. The electronic circuit detects this, thereby realizing a state where the room lamp is extinguished, for example.

Namely, manipulation member 5 is moved upwardly and downwardly by being pushed, so that movable contact point 7 placed in the upward and downward direction, which is parallel with manipulation member 5, is swayed in the leftward and rightward directions with common contact point 2 served as a fulcrum point. This causes movable contact point 7 to bend, thereby bringing the upper and lower end thereof into elastic contact with one of fixed contact points 3 and 4. Thus, common contact point 2 is adapted to be electrically connected to or separated from fixed contact points 3 and 4, through movable contact point 7.

Further, as information about prior-art documents relating to the invention of the present application, Unexamined Japanese Patent Publication No. 2007-18790 has been known, for example.

SUMMARY

However, in the aforementioned conventional push switch, movable contact point 7 is placed in the upward and downward direction, which is parallel with manipulation member 5. This causes the entire push switch to have a larger height. Furthermore, since movable contact point 7 is adapted to be elastically deformed for electrically connecting and separating common contact point 2 to and from fixed contact points 3 and 4, it is necessary to form movable contact point 7 to have a thin-plate shape. This has induced the problem that the push switch can be used only for switchovers of smaller electric currents.

The present invention has been made in order to overcome the aforementioned conventional problems and aims at providing a push switch having a reduced height and being able to be certainly manipulated.

In order to attain the aforementioned object, according to the present invention, there is provided a push switch including a case with a substantially-box shape, a cover, a manipulation member, a movable contact point, and a spring with a substantially-U-shape. The case with the substantially-box shape is provided with a common contact point and a fixed contact point in its inner bottom surface, and the cover is adapted to cover an upper surface of the case. The manipulation member is housed in the case such that the manipulation member is movable upwardly and downwardly, and the manipulation member has a manipulation portion protruded upwardly from the cover. The movable contact point is swayably placed on the common contact point and is extended in a leftward and rightward direction. The spring with the substantially-U-shape has one end hitched on a lower surface of the cover, the other end slidably placed on an upper surface of the movable contact point, and a center portion being in elastic contact with a lower surface of the manipulation member.

Since the movable contact point is placed in the direction orthogonal to the direction of upward and downward movements of the manipulation member, it is possible to make the entire push switch have a reduced height and, also, it is possible to form the movable contact point to have a larger thickness. This enables to certainly perform connection and separation of relatively-larger electric currents of about several amperes therethrough.

As described above, according to the present invention, it is possible to realize a push switch having a reduced height and being able to be manipulated certainly.

DETAILED DESCRIPTION OF THE PREFERRED EMBODIMENT

Hereinafter, an embodiment of the present invention will be described, with reference to FIGS. 1 to 3.

First Exemplary Embodiment

Figure 1:
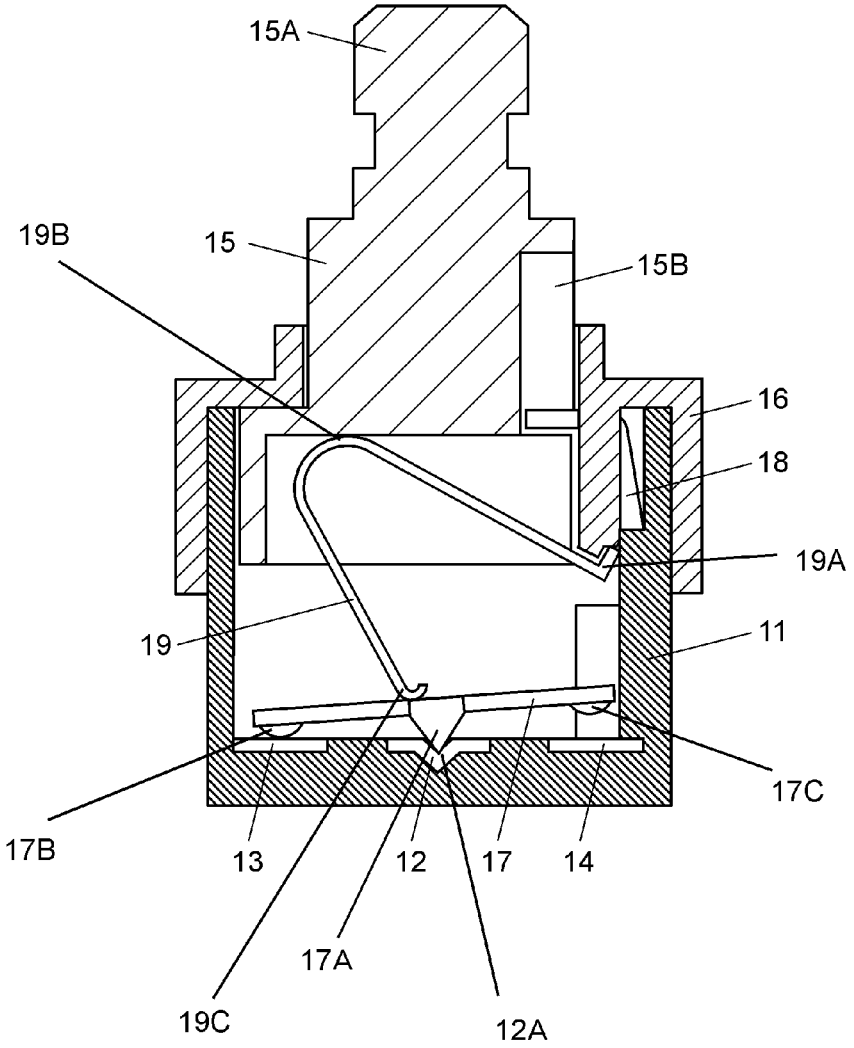
FIG. 1 is a cross-sectional view of a push switch according to an embodiment of the present invention.
Figure 2:
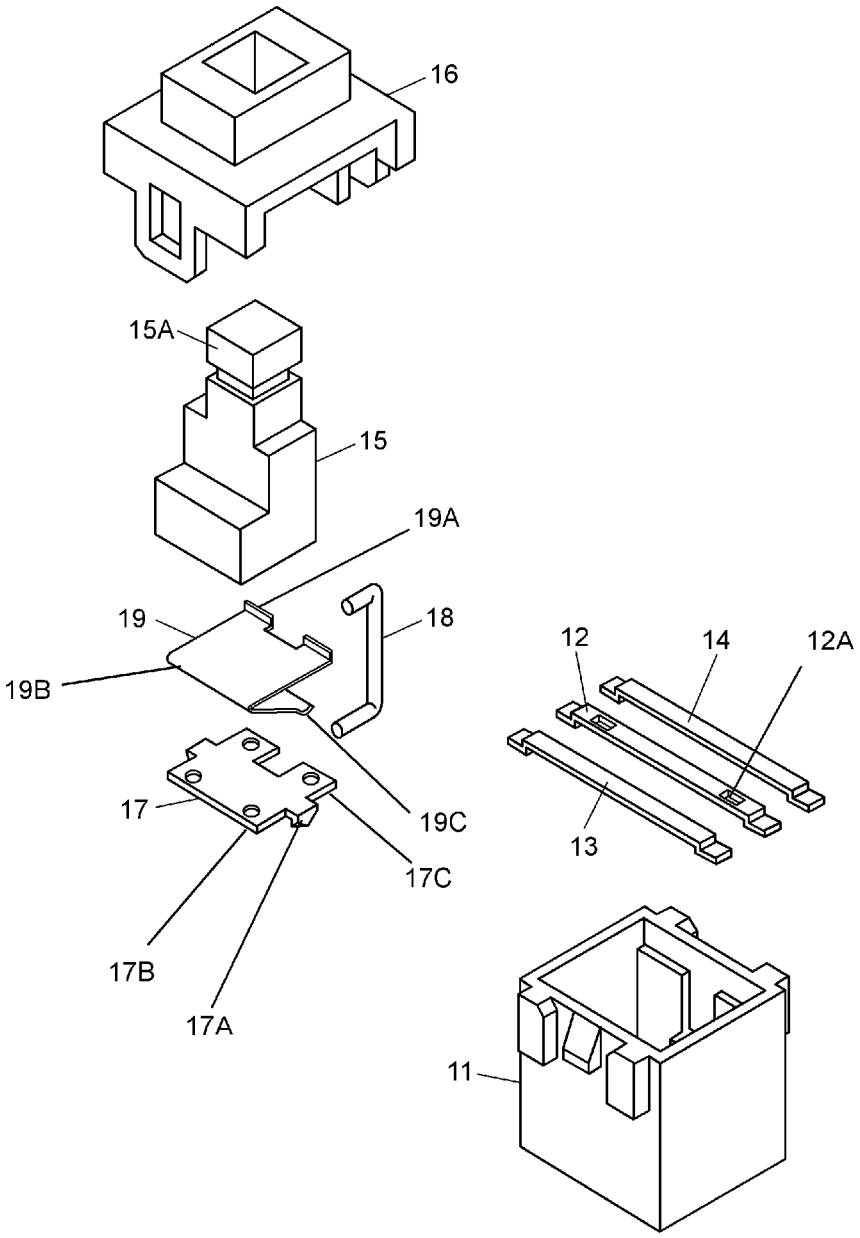
FIG. 2 is an exploded perspective view of the push switch according to the embodiment of the present invention.

FIG. 1 is a cross-sectional view of a push switch according to an embodiment of the present invention, and FIG. 2 is an exploded perspective view of the same. Referring to FIG. 1 and FIG. 2, "11" designates a case having an opened upper surface and having a substantially-box shape, wherein the case is made of an insulating resin, such as a liquid crystal polymer or a polyphenylene sulfide. "12" designates a common contact point made of a conductive metal such as a copper alloy, and "13" and "14" designate a first fixed contact point and a second fixed contact point which are also made of conductive metals. Common contact point 12 is secured to the inner bottom surface of case 11 at its center portion, while first fixed contact point 13 and second fixed contact point 14 are secured thereto on the left and the right of common contact point 12, through insert molding and the like. Common contact point 12 has an upper surface provided with concave portion 12A.

Further, "15" designates a manipulation member made of an insulating resin, such as polybutylene terephthalate or polyoxymethylene. "16" designates a cover made of an insulating resin, similarly. Cover 16 is adapted to cover the opening portion in the upper surface of case 11, and manipulation member 15 is housed within case 11 such that manipulation member 15 is movable upwardly and downwardly. Manipulation portion 15A at the upper end of manipulation member 15 is upwardly protruded, through an opening in the upper surface of cover 16.

Further, "17" designates a movable contact point which is formed from a conductive metal plate made of a copper alloy and the like, and "18" designates a stopper with a substantially angular-U shape which is formed from a metal wire, such as a steel wire. Movable contact point 17 is swayably placed, at its center portion, on common contact point 12. Movable contact point 17 includes a center contact portion 17A which comes in contact with common contact point 12 and protrudes toward common contact point 12. Center contact portion 17A is positioned in concave portion 12A in common contact point 12. Further, movable contact point 17 includes, at its left end, first contact portion 17B which comes in contact with first fixed contact point 13 and, further, includes, at its right end, second contact portion 17C which comes in contact with second fixed contact point 14. Movable contact point 17 can move in such a way as to move first contact portion 17B and second contact portion 17C upwardly and downwardly, with center contact portion 17A served as a fulcrum point. Stopper 18 is engaged, at its upper end, in substantially-heart shaped cam slot 15B formed in the right side surface of manipulation member 15, while the lower end of stopper 18 is hitched in the right inner side wall of case 11.

Further, "19" designates a spring with a substantially-U-shape which is formed from a metal thin plate made of a copper alloy, a steel or the like. In a state where it is slightly bent, its upper end 19A is hitched on the lower surface of cover 16. Center portion 19B of spring 19 is in elastic contact with the lower surface of manipulation member 15, while lower end 19C of spring 19 is in elastic contact with the upper surface of movable contact point 17 in the left side thereof. This is a state where common contact point 12 and first fixed contact point 13 are electrically connected to each other through movable contact point 17. This spring 19 biases manipulation member 15 upwardly, thereby forming the push switch. Further, upper end 19A and lower end 19C of spring 19 are not limited in terms of the positional relationship therebetween in the upward and downward directions and merely represent one end and the other end thereof.

Further, the push switch having the aforementioned structure is mounted in an automobile interior, in a state where a push button or the like is mounted on manipulation portion 15A. Further, the push switch is placed on a printed wiring board (not illustrated) having a plurality of wiring patterns formed on its upper and lower surfaces. Common contact point 12, first fixed contact point 13 and second fixed contact point 14, which are protruded through the outer side wall of case 11, are soldered to predetermined wiring patterns and, thus, are electrically connected to an electronic circuit (not illustrated) in a vehicle or a device.

Figure 3:
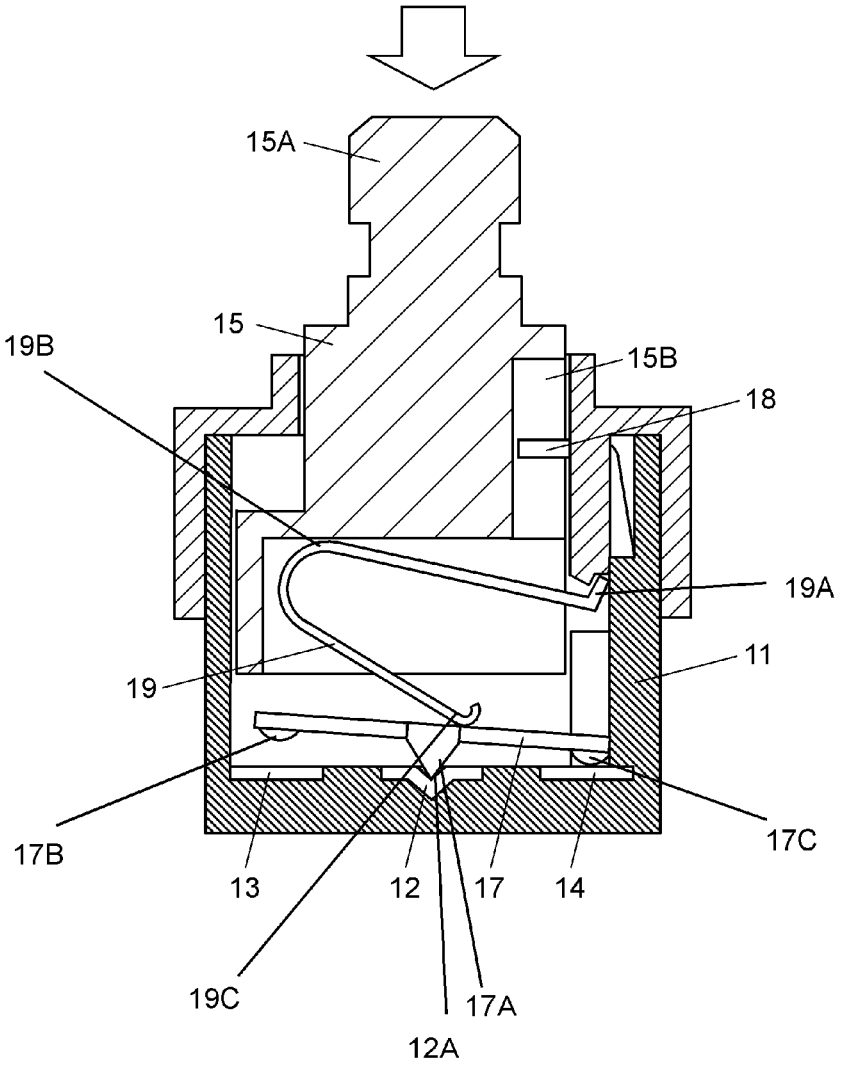
FIG. 3 is a cross-sectional view of the push switch according to the embodiment of the present invention, in a state where it has been manipulated by pushing.
Figure 4:
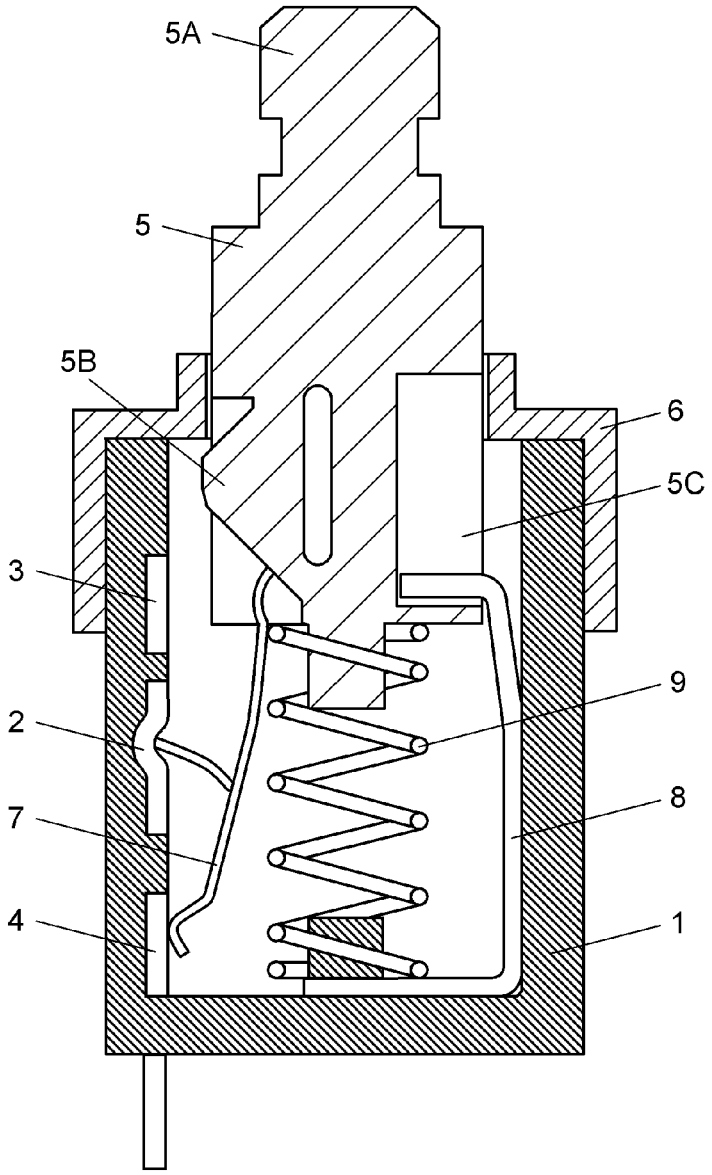
FIG. 4 PRIOR ART
FIG. 4 is a cross-sectional view of a conventional push switch.
Figure 5:
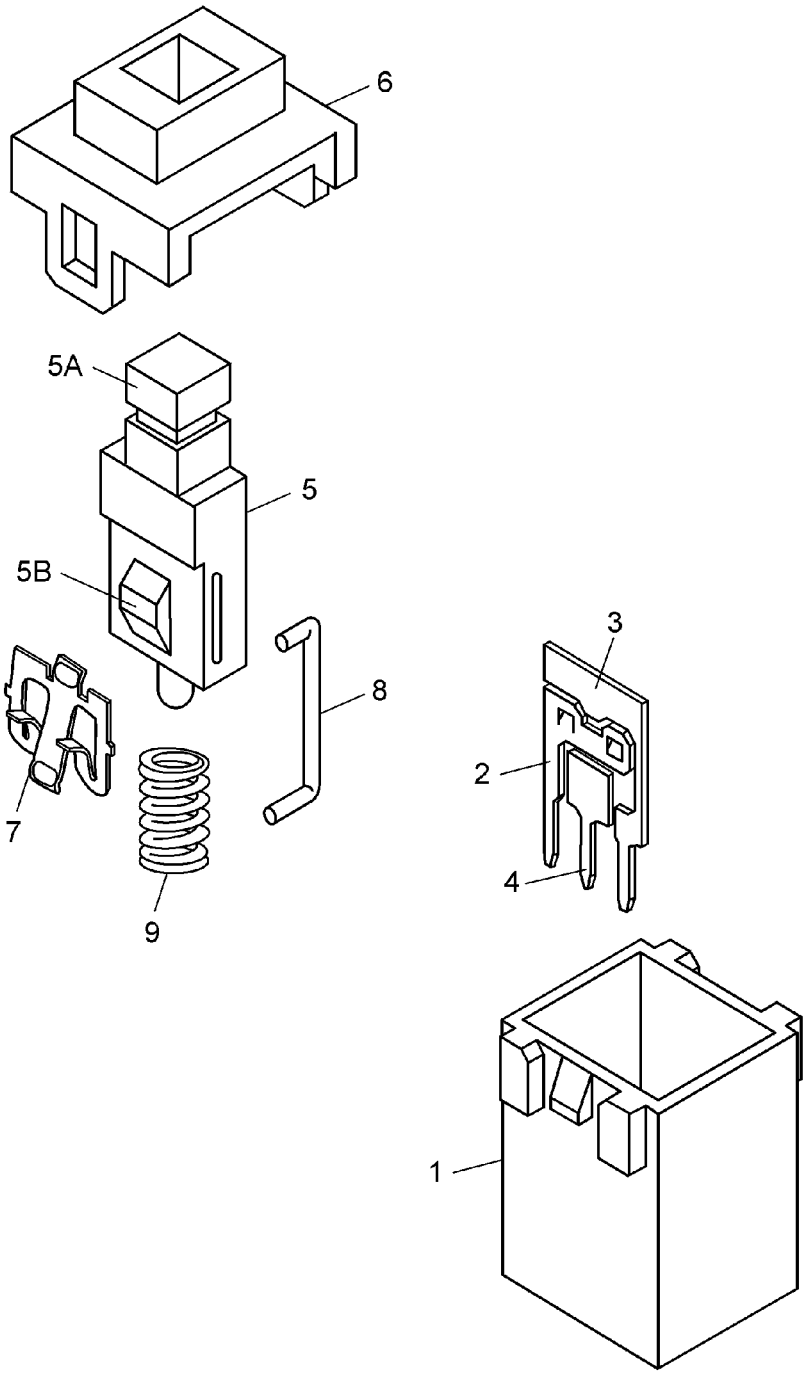
FIG. 5 PRIOR ART
FIG. 5 is an exploded perspective view of the conventional push switch.
Figure 6:
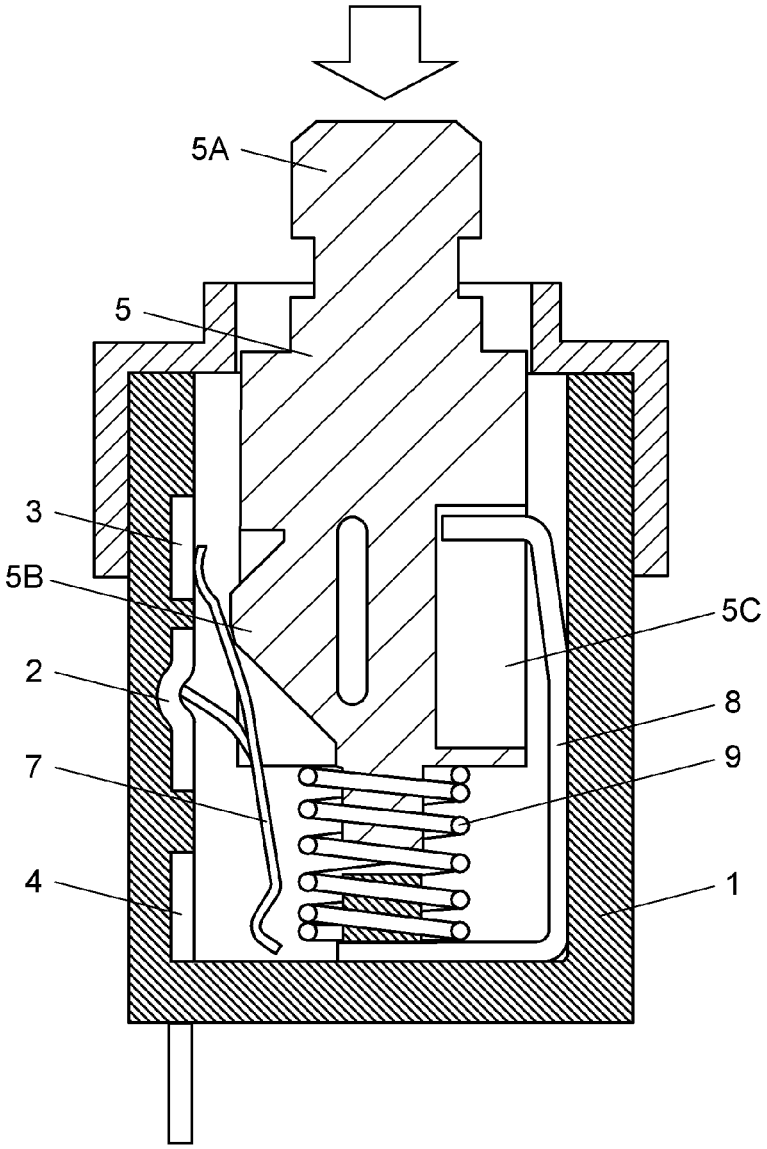
FIG. 6 PRIOR ART
FIG. 6 is a cross-sectional view of the conventional push switch, in a state where it has been manipulated by pushing.

In the aforementioned structure, if manipulation portion 15A is pushed, manipulation member 15 moves downwardly in case 11 while bending spring 19, as illustrated in the cross-sectional view in FIG. 3. Lower end 19C of spring 19 slides rightwardly on the upper surface of movable contact point 17 while being in elastic contact therewith. Movable contact point 17 sways in the upward and downward directions with common contact point 12 served as a fulcrum point, so that first contact portion 17B at the left end thereof is separated from first fixed contact point 13, while second contact portion 17C at the right end thereof comes into elastic contact with second fixed contact point 14. This realizes a state where common contact point 12 is electrically connected to second fixed contact point 14 through movable contact point 17.

Further, at the same time, the upper end of stopper 18 slides in cam slot 15B having the substantially-heart shape, while being in elastic contact therewith. If manipulation member 15 is moved downwardly by a predetermined distance, the upper end of stopper 18 is hitched in cam slot 15B, thereby realizing a state where manipulation member 15 is locked. The electronic circuit detects that common contact point 12 is being electrically separated from and connected to first fixed contact point 13 and second fixed contact point 14, thereby turning on a room lamp, for example.

Further, if manipulation portion 15A is pushed, again, to move manipulation member 15 downwardly by a predetermined distance, the upper end of stopper 18 slides in cam slot 15B while being in elastic contact therewith, thereby releasing the lock. Manipulation member 15 is upwardly biased by spring 19, which separates second contact portion 17C at the right end of movable contact point 17 from second fixed contact point 14, thereby returning to the original state where first contact portion 17B at the left end of movable contact point 17 is in elastic contact with first fixed contact point 13. The electronic circuit detects this, thereby realizing a state where the room lamp is extinguished, for example.

Namely, manipulation member 15 is moved upwardly and downwardly by being pushed, so that the lower surface of this manipulation member 15 presses the center portion of spring 19. Spring 19 is elastically deformed, and lower end 19C of spring 19 slides leftwardly and rightwardly on the upper surface of movable contact point 17, while being in elastic contact therewith. Movable contact point 17 sways in the upward and downward directions with common contact point 12 served as a fulcrum point, so that one of first contact portion 17B and second contact portion 17C at the left and right ends of movable contact point 17 is brought into elastic contact with first fixed contact point 13 or second fixed contact point 14. Thus, common contact point 12 is adapted to be electrically connected to or separated from first fixed contact point 13 and second fixed contact point 14, through movable contact point 17.

Further, in the present invention, common contact point 12, first fixed contact point 13 and second fixed contact point 14 are formed in the inner bottom surface of case 11, rather than in the right and left inner side walls thereof. Movable contact point 17 is placed swayably, at its center portion, on common contact point 12, and movable contact point 17 is placed in the direction orthogonal to the direction of upward and downward movements of manipulation member 15. This enables to form case 11 such that it has a smaller heightwise size, thereby reducing the height of the entire push switch.

Further, spring 19 having a thin-plate shape is in elastic contact, at its lower end, with the upper surface of movable contact point 17 and, if spring 19 is elastically deformed, this causes movable contact point 17 to sway. This causes first contact portion 17B or second contact portion 17C at the left or right end of movable contact point 17 to be connected to or separated from first fixed contact point 13 or second fixed contact point 14. This eliminates the necessity of forming movable contact point 17 to have a thin-plate shape, which enables to form it in such a way as to make its thickness larger to some extent. This enables to certainly perform connection and separation of relatively-larger electric currents of about several amperes, therethrough.

Furthermore, the concave and convex portions and the folded portions in common contact point 12, first fixed contact point 13 and second fixed contact point 14 are all formed in the upward and downward directions, which corresponds to the direction of opening and closing of the dies. Therefore, in cases of securing these contact points to the inner bottom surface of case 11 through insert molding and the like, it is possible to easily attain the insert molding processing with dies with simple structures.

Further, in the aforementioned description, common contact point 12 is provided in the inner bottom surface of case 11 at its center portion, and first fixed contact point 13 and second fixed contact point 14 are provided on the left and right thereof. Further, there has been described a structure for causing first contact portion 17B and second contact portion 17C at the left and right ends of movable contact point 17 to be connected to and separated from first fixed contact point 13 or second fixed contact point 14. However, the present invention can be also implemented, with a structure which is provided with only one of first fixed contact point 13 and second fixed contact point 14 such that one end of movable contact point 17 is connected thereto or separated therefrom.

As described above, according to the present embodiment, movable contact point 17 is swayably placed on common contact point 12 in the inner bottom surface of case 11. Upper end 19A of spring 19 having a substantially-U-shape is hitched on the lower surface of cover 16, and lower end 19C and center portion 19B thereof are in elastic contact with the upper surface of movable contact point 17 and the lower surface of manipulation member 15, respectively. Thus, movable contact point 17 is placed in the direction orthogonal to the direction of upward and downward movements of manipulation member 15, which enables to reduce the height of the entire push switch. Furthermore, movable contact point 17 can be formed to have a larger thickness, which enables provision of the push switch capable of certainly performing connection and separation of relatively-larger electric currents of about several amperes therethrough.

The push switch according to the present invention has the advantageous benefits of having a reduced height and also being able to be certainly manipulated and, therefore, the push switch can be effectively utilized mainly for manipulating various types of electronic devices.

What is claimed is:

1. A push switch comprising:

a case with a substantially-box shape which has an inner bottom surface in which a common contact point and a fixed contact point are formed;

a cover adapted to cover an upper surface of the case;

a manipulation member which is housed in the case such that the manipulation member is movable in an upward and downward direction, the manipulation member having a manipulation portion protruded upwardly from the cover;

a movable contact point which is swayably placed on the common contact point and is extended in a leftward and rightward direction orthogonal to the upward and downward direction; and a spring which has one end, another end and a center portion between the one end and the another end, the one end being hitched on a lower surface of the cover, the another end being configured to move slidably in the leftward and rightward direction on an upper surface of the movable contact point when the manipulation member moves in the upward and downward direction, the center portion being in elastic contact with a lower surface of the manipulation member, wherein a cross section of the spring linking the one end to the another end via the center portion has a substantially-U-shape.

2. The push switch according to claim 1, wherein the fixed contact point comprises a first fixed contact point and a second fixed contact point which are located on both sides of the common contact point respectively, and the movable contact point includes a center contact portion which is in contact with the common contact point and protrudes toward the common contact point, a first contact portion which comes in contact with the first fixed contact point, and a second contact portion which comes in contact with the second fixed contact point.

3. The push switch according to claim 2, wherein the movable contact point is adapted to move the first contact portion and the second contact portion in the upward and downward direction, with the center contact portion served as a fulcrum point.

4. The push switch according to claim 2, wherein the another end of the spring is adapted to slide on the upper surface of the movable contact point, in such a way as to pass above the center contact portion of the movable contact point.

5. The push switch according to claim 2, wherein the common contact point has an upper surface provided with a concave portion, and the center contact portion of the movable contact point is positioned in the concave portion.

6. The push switch according to claim 2, wherein the common contact point, the first fixed contact point and the second fixed contact point are protruded through an outer side wall of the case.

7. The push switch according to claim 1, wherein the spring is made of a copper alloy or steel.

8. The push switch according to claim 1, wherein the spring is formed from a metal thin plate.

9. The push switch according to claim 8, wherein the metal thin plate is bent.

10. The push switch according to claim 1, wherein:

the fixed contact point comprises a first fixed contact point which is located apart from the common contact point, and the movable contact point includes a center contact portion which is in contact with the common contact point and protrudes toward the common contact point, a first contact portion which comes in contact with the first fixed contact point.

11. The push switch according to claim 1, wherein the push switch includes no spring with a cross section having a substantially U-shape other than the spring.

* * * * *